US007674981B1

(12) United States Patent
Hesselbarth et al.

(10) Patent No.: US 7,674,981 B1
(45) Date of Patent: Mar. 9, 2010

(54) STRUCTURED DIELECTRIC FOR COAXIAL CABLE

(75) Inventors: Jan Hesselbarth, Zurich (CH); Erhard Mahlandt, Laatzen (DE); Alan Michael Lyons, New Providence, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 0 days.

(21) Appl. No.: 12/237,855

(22) Filed: Sep. 25, 2008

(51) Int. Cl.
*H01B 7/00* (2006.01)

(52) U.S. Cl. ..... 174/110 R; 174/112; 174/113 AS; 174/28

(58) Field of Classification Search ..... 174/28, 174/29, 36, 102 R, 102 SP, 110 R, 112, 113 R, 174/113 C, 113 AS; 333/84 L, 237
See application file for complete search history.

(56) References Cited

U.S. PATENT DOCUMENTS 2,035,274 A * 3/1936 Mougey ..... 174/29
2,556,244 A * 6/1951 Weston ..... 174/29
3,126,438 A * 3/1964 Lorrin ..... 174/29
3,496,281 A * 2/1970 McMahon ..... 174/29
3,514,523 A * 5/1970 Hildebrand et al. ..... 174/28
3,767,838 A * 10/1973 McConnell ..... 174/25 G
5,130,497 A 7/1992 Yoshikawa
5,262,593 A * 11/1993 Madry et al. ..... 174/102 R
5,742,002 A 4/1998 Arredondo et al.
6,346,671 B1 * 2/2002 Ahrens et al. ..... 174/28
7,271,344 B1 * 9/2007 Stutzman et al. ..... 174/113 R

OTHER PUBLICATIONS

Plate, et al., "Reassessment of Polyethylen Power Cable", IEEE Winter General Meeting, Dec. 1963, pp. 990-1002, NY.NY.

* cited by examiner

*Primary Examiner*—William H Mayo, III
(74) *Attorney, Agent, or Firm*—Kramer & Amado, PC

(57) ABSTRACT

A geometrically-structured coaxial cable may prevent infiltration of water vapor and other contaminants by using a closed cell structure. The cable may be fabricated by wrapping bubble tape around its central conductor. Alternatively, plastic may be extruded through channels to create a plurality of layers. In either case, these layers are staggered in a zig-zag pattern to ensure that no radial spokes connect the inner and outer conductors of the coaxial cable without passing through a plurality of dielectric layers.

12 Claims, 7 Drawing Sheets

STRUCTURED DIELECTRIC FOR COAXIAL CABLE

BACKGROUND OF THE INVENTION

1. Field of the Invention

This invention relates generally to radio/microwave frequency hardware. In particular, it relates to a dielectric that prevents moisture from entering coaxial cables and methods of manufacturing cables incorporating such a dielectric.

2. Description of Related Art

Coaxial cables are widely used for the transmission of analog and digital signals at radio and microwave frequencies. A typical coaxial cable consists of a metallic inner conductor, a dielectric material, and a metallic outer conductor arranged in a circular, concentric manner. The signal transmitted across the cable appears as an electromagnetic field in the dielectric, causing electrical currents to flow through the inner and outer conductors. During transmission, the signal may experience attenuation due to the resistance of the inner and outer conductors and the loss factor of the dielectric material.

In order to minimize the transmission loss of signal, artisans may select particular materials for coaxial cables. The materials for the inner and outer conductors are chosen to minimize resistance. A designer may also pick materials having the lowest dielectric loss. The dielectric material should also be selected for minimal permittivity.

Permittivity values describe how well an electric field can permeate a dielectric material. A perfect dielectric would have no conductivity, so it would be able to store and return electrical energy as an ideal capacitor. Real dielectrics have some conductivity, so the electrical current will not be entirely confined to the inner and outer conductors of the coaxial cable.

For the inner and outer conductors, economic and mechanical constraints usually result in the selection of a particular type of metal. Silver has the highest electrical conductivity of any metal. Copper, gold, and aluminum also have high conductivity values.

A dielectric constant, also known as "relative permittivity," is used to measure the relative effectiveness of a dielectric. By definition, an absolute vacuum has a dielectric constant of 1. Air, having a dielectric constant of 1.0054, has similar electrical characteristics to a vacuum. However, something other than air must be placed between the inner and outer conductors to ensure their mechanical stability. In particular, the dielectric layer should ensure that the conductors remain concentrically aligned.

Coaxial cables that use air as a dielectric have very good signal propagation characteristics. However, such cables are quite vulnerable to bending, as air is unlikely to stop the inner and outer conductors' from contacting each other if the cable is abruptly bent. In addition, the electrical performance of an air-filled cable will deteriorate rapidly if any moisture intrudes.

In contrast, coaxial cables using a foam dielectric type possess significantly better bending properties than air dielectric cables. Cables which use a solid polymer dielectric are also less expensive, but are less efficient at transmitting and receiving signal because air has a much lower dielectric constant than solid polymers. Therefore, most designers prefer using a foam dielectric instead of a solid polymer.

Other coaxial cables may contain polyethylene or another resin in their dielectric layers. Such cables often require application of antioxidants to provide protection against oxidative degradation of their resins. These cables may also be vulnerable to moisture migration between the insulation and the inner and outer conductors. Moisture may react with the metallic surface of the conductors, causing corrosion to develop.

High frequency coaxial cables may use dielectric materials such as polyethylene (PE) and polytetrafluoroethylene (PTFE), and substances derived from PE or PTFE. These materials have relative permittivity values in the 2.0 to 2.4 range. The relative permittivity of these substances can be further reduced by adding air.

For example, the plastic might be extruded to convert it into foam. Alternatively, microscopic fissures could be created in the material to admit air. These techniques can only add a limited amount of air without impairing the dielectric's ability to provide mechanical stability. In particular, if too much air is added, the inner and outer conductors will not remain in place if the coaxial cable is bent or twisted.

Coaxial cables that use air as a dielectrics need to prevent moisture from entering the air pockets. If water collects in these spaces; it may significantly degrade the quality of the cable. More specifically, water can significantly increase the dielectric constant, thereby producing power loss and corrosion of the metallic conductors. Accordingly, there is a need for a coaxial cable with low loss that prevents the intrusion of moisture into the dielectric.

Water vapor is known to enter coaxial cables in several ways. It can diffuse through the jacket surrounding the outer conductor or through holes that form in the jacket. Even worse, water can flow into the cable if a terminal end is not sealed. In such cases, water can quickly fill the gap between the inner and outer conductors, causing the dielectric constant to rise rapidly. Thus, there is a need to limit water intrusion into the dielectric layers of a coaxial cable.

SUMMARY OF THE INVENTION

In light of the present need for providing a coaxial cable with a structured dielectric that prevents moisture from entering the cable, a brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

In various exemplary embodiments, a method for fabricating a structured dielectric for a coaxial cable having inner and outer conductors may comprise the following steps: obtaining a polymer dielectric having enclosed cells; wrapping the dielectric around the inner conductor; continuing to wrap the dielectric in a helical manner, ensuring that no radial spokes are formed in the dielectric; and continuing this wrapping process until the dielectric reaches the outer conductor.

In various exemplary embodiments, the polymer dielectric may be a bubble wrap tape, having enclosed cells that protrude from the surface of the tape. Alternatively, the polymer dielectric may be an inverse bubble wrap tape, having enclosed cells that lie below the surface of the tape. Additionally, the polymer dielectric may be a three-layered bubble wrap tape having enclosed cells between upper and lower sheets. In this case, a dimpled sheet sandwiched between the upper and lower sheets may define the enclosed cells in the three-layered bubble wrap tape.

In various exemplary embodiments, a method for fabricating a structured dielectric for a coaxial cable having inner and outer conductors, may comprise the following steps: extruding open channels in a radial pattern above the inner conductor; periodically filling the channels to seal the dielectric; extruding a second layer of open channel above the sealed layer, wherein the second layer is displaced from the first layer to ensure that radial spokes are not formed; applying this extrusion process to all layer so that the dielectric extends from the inner conductor to the outer conductor.

In various exemplary embodiments, the extrusion process may occur incrementally, proceeding layer by layer from the inner conductor to the outer conductor. Alternately, multiple extruders may operate on the layers in parallel, thereby permitting the dielectric to be extruded in a single operation.

The foregoing objects and advantages of the invention are illustrative of those that can be achieved by the various exemplary embodiments and are not intended to be exhaustive or limiting of the possible advantages which can be realized. Thus, these and other objects and advantages of the various exemplary embodiments will be apparent from the description herein or can be learned from practicing the various exemplary embodiments, both as embodied herein or as modified in view of any variation that may be apparent to those skilled in the art. Accordingly, the present invention resides in the novel methods, arrangements, combinations, and improvements herein shown and described in various exemplary embodiments.

BRIEF DESCRIPTION OF THE DRAWINGS

In order to better understand various exemplary embodiments, reference is made to the accompanying drawings, wherein.

DETAILED DESCRIPTION OF THE PREFERRED EMBODIMENTS OF THE INVENTION

Figure 1A:
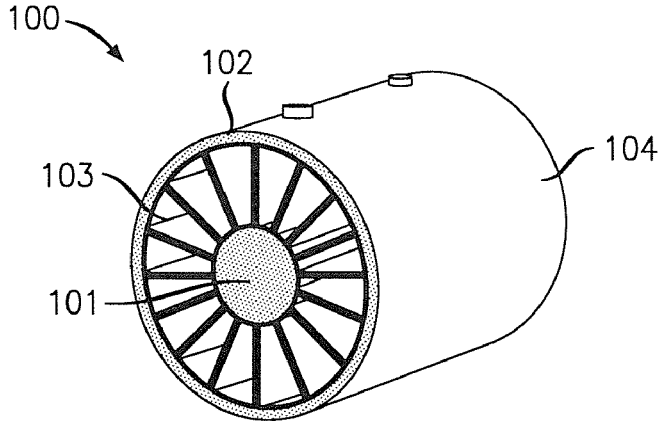
FIGS. 1A, 1B, and 1C show cross-sectional views of structured dielectric layers.

Referring now to the drawings, in which like numerals refer to like components or steps, there are disclosed broad aspects of various exemplary embodiments.

Figure 1B:
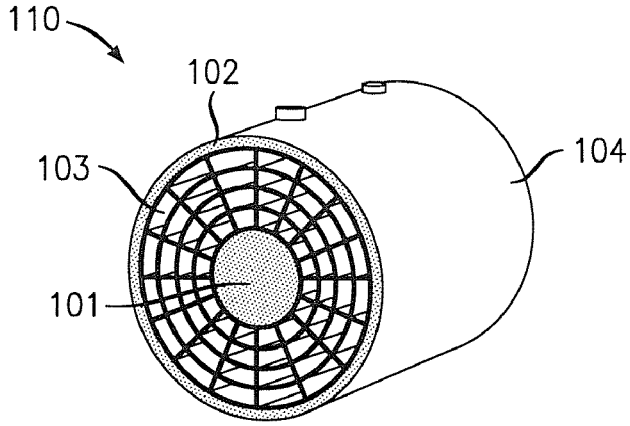
Figure 1C:
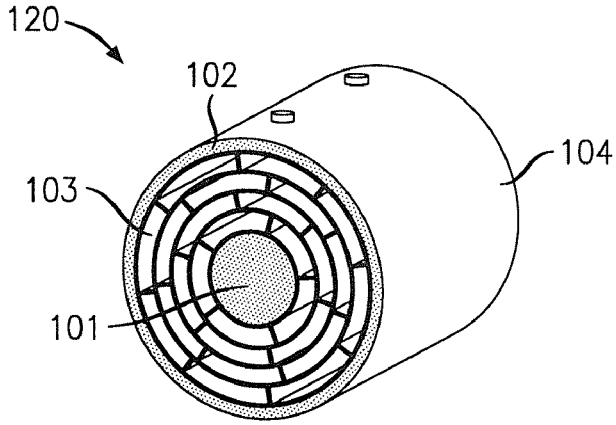

FIGS. 1A, 1B, and 1C show cross-sectional views of structured dielectric layers. The three coaxial cables 100, 110, and 120 depicted in FIGS. 1A, 1B, and 1C, respectively, share three common elements.

First, an inner conductor 101 is located in the center of each cable 100, 110, 120. Inner conductor 101 may be fabricated from an electrically conductive metal. It should be apparent that any electrically conductive metal may be used according to cost and design requirements. Thus, in various exemplary embodiments, the metal used for conductor 101 is copper, silver, copper-plated aluminum, or any other conductive metal.

Second, an outer conductor 102 defines the circumference of each cable 100, 110, and 120. Outer conductor 102 may consist of braided copper wire. However, it should be apparent that any electrically conductive metal may be used for outer conductor 102. A protective jacket 104 may surround outer conductor 102 to protect the contents of cable 100, 110, 120. Any insulating material may be used for jacket 104, such as rubber or non-conductive plastic.

Third, a dielectric 103 separates inner conductor 101 from outer conductor 102. Dielectric 103 is fabricated from a relatively non-conductive material. For example, bubble tape or extruded plastic may be used for dielectric 103. Dielectric 103 serves to provide mechanical stability to cable 100, 110, 120, while attempting to mitigate signal losses.

Referring now to FIG. 1A, coaxial cable. 100 contains spokes radiating from an inner conductor toward an outer conductor. This dielectric structure results in significant power leakage due to the radial symmetry of dielectric 103. Moreover, the dielectric 103 uses only one mass of dielectric material instead of having multiple layers. Consequently, there is a greater likelihood of loss of energy due to inductive action.

Referring now to FIG. 1B, coaxial cable 110 comprises spokes similar to those of cable 100, but also possesses concentric circles in the dielectric. Thus, the cross-section of the dielectric 103 has a web-like pattern. However, it should be apparent that although dielectric 103 includes multiple layers, each of the layers is radially symmetric. Thus, significant power loss occurs due to the direct connection between inner conductor 101 and outer conduct 102.

FIG. 1C depicts a coaxial cable 120 having layers of dielectric arranged in an interrupted manner. Thus, cable 120 does not have spokes radiating out from its inner conductor. Instead, cable 120 interposes at least one insulating layer in every radial direction. It is well-established that better characteristics may be attained in an insulated sheath by dividing it, causing the ends of the insulated divisions or sections of the same to overlap, and interposing a suitable insulating material between the overlapping portions. Consequently, this dielectric structure has the lowest effective permittivity and the lowest loss factor.

Figure 2:
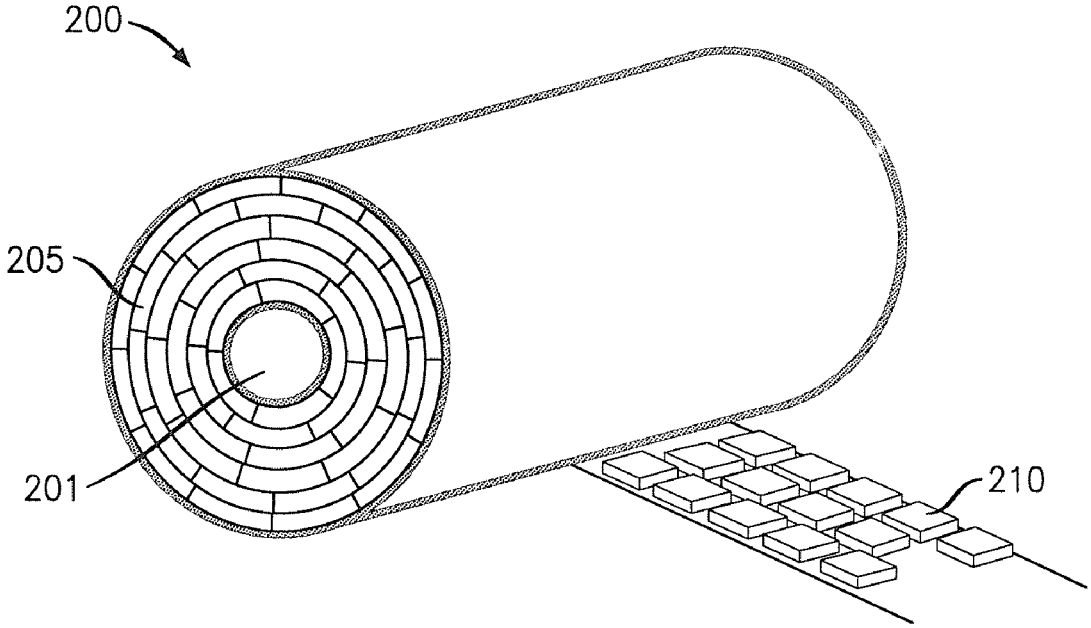
FIG. 2 depicts another cross-sectional view of a coaxial cable.

FIG. 2 depicts another cross-sectional view of a coaxial cable 200 including a structured dielectric 205 similar to that described above with reference to FIG. 1C. In various exemplary embodiments, this structure is obtained by wrapping "bubble tape" around the inner conductor 201. The protruding bubbles or cells 210 on the tape are sealed such that they are impervious to water vapor. In various exemplary embodiments, the bubbles are sized to be no larger than 5% of the effective wavelength of electric fields in the dielectric.

A first simulation for FIG. 2 involved a coaxial cable having an outer diameter of 40 mm and a maximum operating frequency of 2 GHz. In this case, the free-space wavelength was 150 mm. Due to the presence of the dielectric, the effective wavelength would be reduced to 130 mm. For this example, the largest allowable bubble size would be in the order of 6.5 mm.

A second simulation for FIG. 2 involved a coaxial cable having an outer diameter of 20 mm and a maximum operating frequency of 4 GHz. In this case, the free-space wavelength was 75 mm. Due to the presence of the dielectric, the effective wavelength would be reduced to 65 mm. For this example, the largest allowable bubble size would be in the order of 3.25 mm.

Due to mechanical and production constraints, it may be more effective to fabricate bubbles that are considerably smaller than the limits set by proportionality to the effective wavelength. While the size limit might be reached in a longitudinal direction, it may be desirable to reduce the thickness of the bubbles. For example, plastic rib structures defining the latitudinal direction of the bubbles might be between 0.5 mm and 1.2 mm in thickness.

Figure 3:
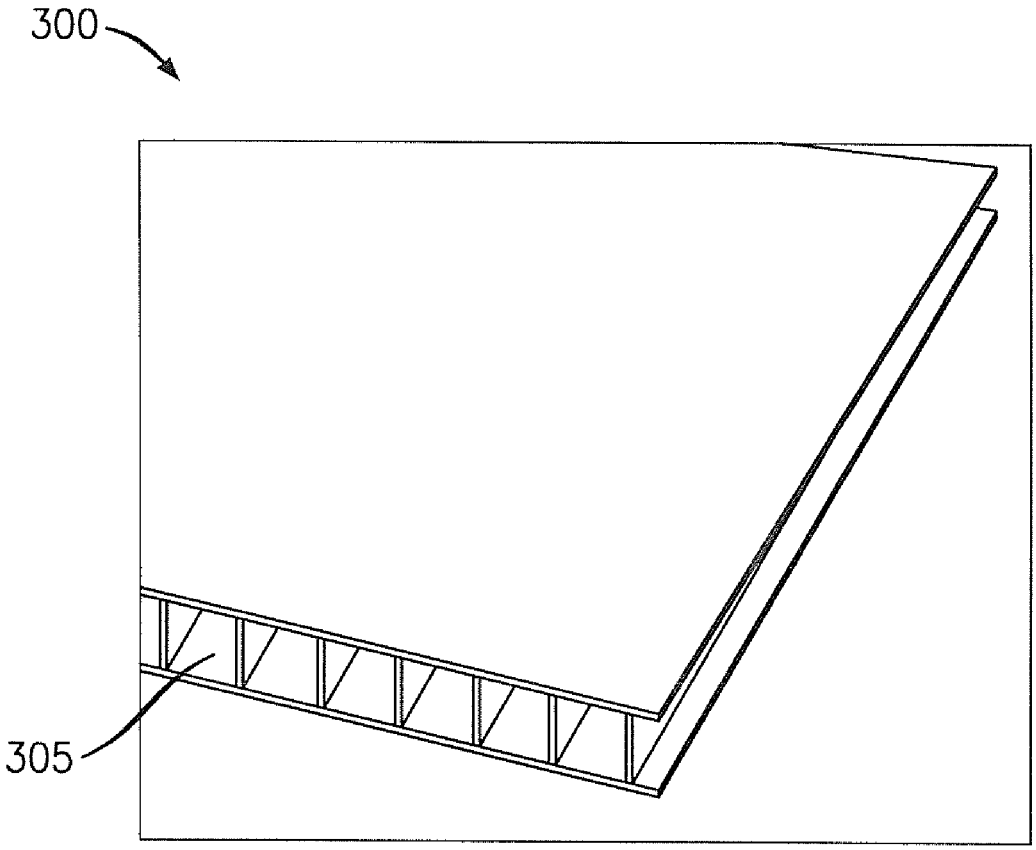
FIG. 3 shows a typical polymer dielectric.

FIG. 3 shows a typical polymer dielectric 300 having rectangular channels 305. More specifically, polymer dielectric 300 is a commercially available dielectric by Coroplast including rectangular channels 300 extruded from a polymer dielectric (polypropylene). While these corrugated plastic sheets are somewhat resistant to humidity, they do not act as a true vapor-barrier. In particular, water could collect along the elongated channels defined within the plastic. In some cases, it may be essential to deliberately inject water into the rectangular channels 300.

Coroplast™ sheets may be used in heat exchangers. For this sort of application, the extruded polypropylene is provided in large blocks that are subsequently cut to a desired size. Air can pass through the polypropylene extrusions during operation of a heat exchanger, as shown in U.S. Pat. No. 4,512,392, but contaminants can also pass through the same channels 300. Therefore, water may be injected into the channels 300 of the heat exchanger along the normal path of air to wash the path free from contaminants which have collected.

Figure 4A:
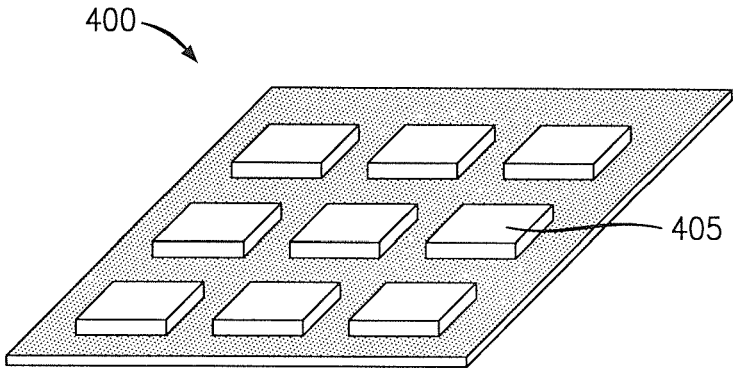
FIGS. 4A, 4B, and 4C depict three different types of plastic wrap having closed cells.
Figure 4B:
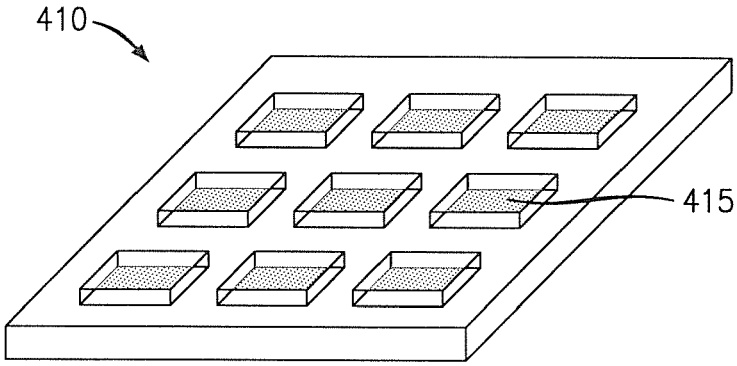
Figure 4C:
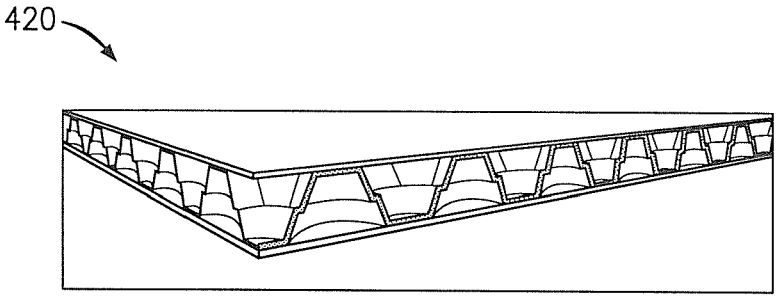

FIGS. 4A, 4B, and 4C depict three different types of plastic wrap 400, 410, 420 having closed cells.

Bubble Wrap™ plastic is a common substance that provides an air cushion, making it useful for protecting items during transport. According to Sealed Air Corp., Bubble Wrap™ manufacturing starts as polyethylene resin, in the form of beads about the size of pea gravel. These beads then go into an extruder, a long cylinder with a screw inside that runs its entire length. As the screw is turned, heat builds up and the resin melts into a liquid that is squeezed out of the cylinder into two stacked sheets of clear plastic film. One layer of the film is wrapped around a drum with holes punched in it. Suction is then applied, drawing one web of film into the holes that form the bubbles. The second layer of film is then laminated over the first so that when the two films are joined, they stick together and trap the air in the bubbles. Similar extrusion processes may be used to make plastic materials that have bubbles with significantly different shapes.

FIG. 4A depicts a plastic wrap 400 including a plurality of individual cells 405. Unlike the Coroplast material depicted in FIG. 3, the cells 405 in wrap 400 are relatively small. In addition, each cell 405 is sealed and is therefore resistant to diffusion of water vapor into the interior spaces. While Bubble Wrap™ plastic may have regularly spaced, protruding air-filled hemispheres, the cells 405 in wrap 400 may be cubes or cuboids, such that the top face of each cell 405 is flat. This configuration allows each of the cells 405 to be easily wrapped around each other to form a multilayer dielectric.

FIG. 4B depicts an "inverse" wrap 410 having a continuous web of depressed cells 415. The inverse wrap pattern may be more effective at preventing the migration of water and/or water vapor along the coaxial cable. Furthermore, unlike Bubble' Wrap™ plastic, wrap 410 may use flat cells, permitting easy assembly of a multilayer dielectric.

FIG. 4C depicts a third wrap 420 that may effectively reduce the migration of water through the coaxial cable. In various exemplary embodiments, alternating layers of open web and continuous film create sealed channels. The continuous film layer may include thin layers of adhesive to make a sealed and more robust structure.

In various exemplary embodiments, wrap 400, 410, 420 is wrapped around an inner conductor of a coaxial cable to form a cable with superior properties. Wrapping techniques used for this process may include helical or annular wrapping. Helical patterns differ from annular patterns because helical patterns define a periodic cycle of maxima and minima around the cable such that each maximum opposes a minimum along the circumferences of the inner and outer conductors. Therefore, any transverse cross-section taken through the conductor perpendicular to its axis will be radially asymmetric. In contrast, annular patterns are usually symmetric.

By wrapping a continuous web of cells about the inner conductor in a helical manner, the coaxial cable will gain the advantage of having a radially asymmetric cross-section. This will help to reduce the risk of breakdown in the dielectric and decrease energy loss. In addition, such wrapping will mechanically secure the inner conductor within the cable, preventing the inner and outer conductors from touching if the cable was suddenly bent.

The inner conductor of the coaxial cable will generate heat during operation of the cable. If this heat is not dissipated, the overall power capability of coaxial cable may slowly degrade. The foamed polymer may be designed so that the sealed bubbles are arranged for optimal heat conduction, thereby keeping the power capability of the cable high. Heat would be transferred from the metal, typically copper wire, in the inner conductor, through the bubbles in the foamed dielectric to the outer conductor and eventually released into the ambient environment.

Figure 5:
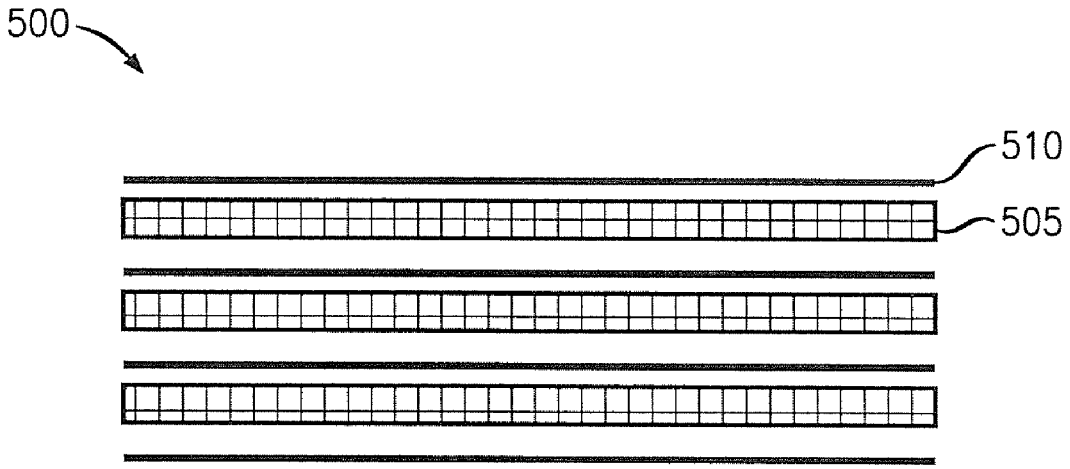
FIG. 5 shows a sealed channel fabrication technique for a plastic wrap layer.

FIG. 5 depicts a sealed channel fabrication technique 500 for a plastic wrap layer. In the technique shown in FIG. 5, mesh layers 505 may be alternated with continuous film 510 to create sealed channels during the wrapping procedure. The continuous film 510 may include thin layers of adhesive to make a sealed and more robust structure. Individual channels may be sealed to prevent diffusion of moisture into the interior spaces.

Figure 6A:
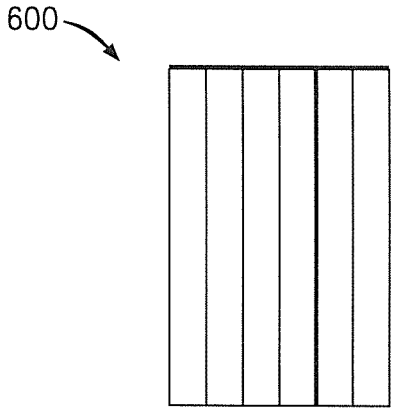
FIGS. 6A, 6B, and 6C show top views of extruded channels.
Figure 6B:
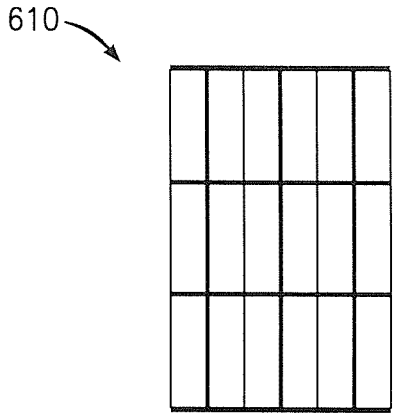
Figure 6C:
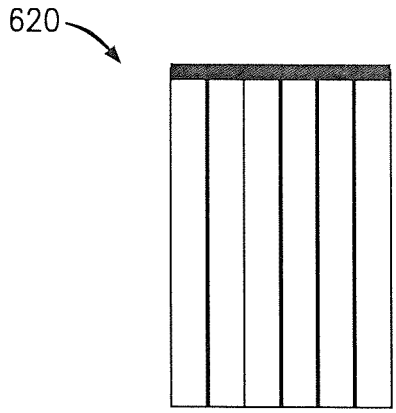

FIGS. 6A, 6B, and 6C show top views of extruded channels.

FIG. 6A depicts an extrusion structure 600 having continuous channels. This structure 600 defines a plurality of channels having rectangular cross-sections. Because these channels are open, they are vulnerable to diffusion of moisture.

FIG. 6B depicts closed cells 610 within extruded channels. Here, individual cells 610 are more resistant to moisture. The cells 610 may have flat, rectangular surfaces, unlike the protruding hemispheres found in Bubble Wrap™ plastic.

FIG. 6C depicts open channels 620 that are periodically closed. While these channels 620 are elongated, they have limited protection against moisture. This structure may be regarded as a modification of the open channels of extrusion structure 600, wherein the initial rectangular channels are subsequently sealed on at least one end.

Figure 7A:
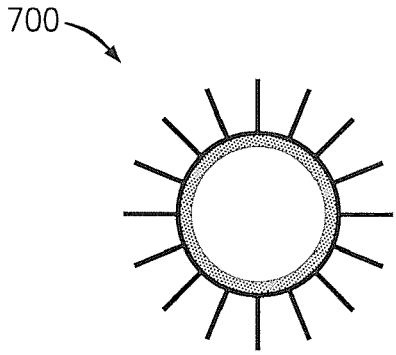
FIGS. 7A, 7B, and 7C show side views of an open channel extrusion process.
Figure 7B:
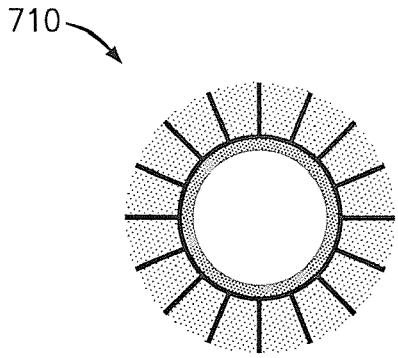
Figure 7C:
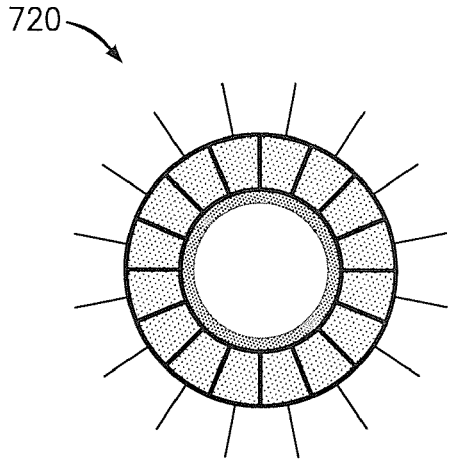

FIGS. 7A, 7B, and 7C show side views of an open channel extrusion process.

FIG. 7A depicts a first step 700 of extruding open channels. In step 700, a first row of open walls are formed. These walls may be near the inner conductor, in a process wherein a multilayer dielectric is assembled in a layer-by-layer procedure. Alternatively, multiple extruders may produce the dielectric in a single step.

It may be important to first extrude foam over the surface of the inner conductor. In some cases, the majority of attenuation in a coaxial cable may be related to the "skin effect" of the electric field on the outer circumference of the inner conductor. In addition, if the inner conductor is made of extremely pure copper wire, it will be quite vulnerable to oxidation. Thus, an extremely thin layer of extruded plastic may completely cover the inner conductor, both to reduce attenuation from the "skin effect" and to physically block oxygen from reacting with the copper.

FIG. 7B depicts a second step 710 of periodically filling the channels. In step 710, the open walls formed in step 700 are sealed. More specifically, in step 710, channels are filled in order to seal the cells. Each cell may be closed to prevent moisture from infiltrating the dielectric of the coaxial cable.

FIG. 7(*c*) depicts a third step 720 of extruding a second layer of channels. In step 720, the second row is extruded above the first layer. The second layer is offset relative to the first channel to ensure that no radial paths directly connect the inner and outer conductors.

As a further alternative, extrusion may involve application of variable air pressure. By modulating the pressure, the extruded plastic may be sent either inward toward the inner conductor or outward toward the outer conductor. Such extrusion may produce an irregular path that results in a final dielectric that is radially asymmetric, having no spokes connecting the inner and outer conductors. This structure will also help to prevent the intrusion of moisture because the irregular dielectric pattern will block the entry of water vapor.

According to the forgoing embodiments, electrical characteristics of a coaxial cable may be improved by using a structured dielectric. This dielectric may have a plurality of layers interposed between an inner, conductor and an outer conductor, arranged in a manner so that at least one sealed bubble is found in any radial line connecting the inner and outer conductors. The sealed bubbles are substantially impervious to water vapor, thereby ensuring that the dielectric constant remains relatively close to the dielectric constant of dry air.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. A coaxial cable that resists moisture intrusion, the cable comprising:

an inner conductor;

an outer conductor disposed at a substantially fixed radius from the inner conductor, the outer conductor being concentric with the inner conductor;

a dielectric having a plurality of layers disposed between the inner conductor and the outer conductor, each layer having a plurality of sealed cells that are fabricated so that the sealed cells that are substantially impervious to water vapor.

2. The cable of claim 1, wherein a maximum size of each sealed cell is no more than 1/20 of an effective wavelength in the dielectric.

3. The cable of claim 1, wherein any radial path between the inner conductor and the outer conductor must pass through at least one sealed cell.

4. The cable of claim 3, wherein any radial path between the inner conductor and the outer conductor must pass through a plurality of sealed cells.

5. A method for fabricating a structured dielectric for a coaxial cable having concentric inner and outer conductors, the method comprising the following steps:

obtaining a dielectric comprising foamed polymer having enclosed cells that are substantially impervious to water vapor intrusion;

wrapping the dielectric around the inner conductor;

continuing to wrap the dielectric in a helical manner to form a plurality of layers between the inner conductor and the outer conductor, ensuring that at least one enclosed cell is disposed in every radial line connecting the inner conductor and the outer conductor.

6. A method as recited in claim 5, wherein the dielectric is a bubble wrap tape comprising enclosed cells that protrude from the surface of the tape.

7. A method as recited in claim 5, wherein the dielectric is an inverse bubble wrap tape comprising enclosed cells that lie below the surface of the tape.

8. A method as recited in claim 5, wherein the dielectric is a three-layered bubble wrap tape having enclosed cells between upper and lower sheets.

9. A method as recited in claim 8, wherein a dimpled sheet sandwiched between the upper and lower sheets defines the enclosed cells in the three-layered bubble wrap tape.

10. A method for fabricating a structured dielectric for a coaxial cable having concentric inner and outer conductors, the method comprising the following steps:

extruding open channels in a radial pattern above the inner conductor;

periodically filling the channels to define a plurality of sealed layers of cells within a dielectric, wherein the sealed layers are substantially impervious to water vapor intrusion;

extruding a layer of open channels above each sealed layer, wherein the layer of open channels is displaced from the sealed layer to ensure that at least one cell is disposed in all radial lines connecting the inner and outer conductors; and repeating the layer extruding step for all sealed layers until the dielectric extends from the inner conductor to the outer conductor.

11. A method as recited in claim 10, wherein the extruding steps occur incrementally, proceeding layer by layer from the inner conductor to the outer conductor.

12. A method as recited in claim 10, wherein multiple extruders operate on the layers in parallel, thereby permitting the dielectric to be extruded in a single operation.

* * * * *